US005638849A

United States Patent [19]

Scott

[11] Patent Number: 5,638,849

[45] Date of Patent: Jun. 17, 1997

[54] PERSONAL SCREEN DEVICE

[76] Inventor: Eugene Scott, 1026 Harlem St., Tallahassee, Fla. 32303

[21] Appl. No.: 501,546

[22] Filed: Jul. 12, 1995

[51] Int. Cl.[6] ..... A47C 7/66

[52] U.S. Cl. ..... 135/96; 403/362; 297/184.15; 297/188.05; 297/188.06; 135/117; 135/88.03

[58] Field of Search ..... 135/117, 118, 135/88.01, 88.03, 96, 90; 297/184.1, 184.11, 184.15, 188.04, 188.05, 188.06; 403/362; 248/295.11

[56] References Cited

U.S. PATENT DOCUMENTS

| | | | |
|---|---|---|---|
| 890,921 | 6/1908 | Perkins | 135/88.03 |
| 972,063 | 10/1910 | Cooper | 135/88.03 |
| 1,149,762 | 8/1915 | Hendrickson | 248/295.11 |
| 2,984,249 | 5/1961 | Sears et al. . | |
| 3,050,280 | 8/1962 | Regan | 135/96 X |
| 4,677,796 | 7/1987 | Mellott | 135/99 X |
| 4,781,411 | 11/1988 | Kolb | 297/184.15 |
| 4,836,231 | 6/1989 | Peterson | 135/118 X |
| 4,836,232 | 6/1989 | De Rosa et al. | 135/118 X |
| 5,000,210 | 3/1991 | Worthington . | |
| 5,255,954 | 10/1993 | Rogers | 135/96 X |
| 5,277,391 | 1/1994 | Haug et al. | 248/295.11 X |
| 5,441,067 | 8/1995 | James et al. | 135/96 |

*Primary Examiner*—Wynn E. Wood
*Attorney, Agent, or Firm*—Peter Loffler

[57] ABSTRACT

The present invention provides for a personal screen device that is adapted to be secured to the back surface of a conventional seat. This personal screen comprises of a shaft includes an upper portion and a lower portion. A shade is secured to the upper portion while the lower portion is adapted to be received within a first holding mechanism and a retaining mechanism. The holding mechanism and the retaining mechanism are secured on the back surface of the conventional seat. The screen of the present invention is designed to be adjustable so that the shade can be raised, lowered, rotated and/or tilted in order to provide an optimum means for blocking sun rays, rain, or the like.

10 Claims, 6 Drawing Sheets

PERSONAL SCREEN DEVICE

BACKGROUND OF THE INVENTION

1. Field of the Invention

The present invention relates generally to a personal screen device and more particularly to a personal screen device that may be attached to a back surface of a chair, sand, dirt, or the like for protecting users from sun, rain, or the like.

2. Description of the Prior Art

Individuals who enjoy the outdoors and/or outdoor activities are often exposed to direct rays of sun. If exposed to these sun rays for an extended period of time, sunburns, heat exhaustion, and/or over-heating can occur. These potential dangerous results, that can occur with too much exposure to the sun, will inherently diminish the enjoyment and the amount of time spent outdoors. Efforts have been made to provide for devices which are used to efficiently and successfully block the sun rays.

Such a device is disclosed in U.S. Pat. No. 2,984,249 issue to Sears et al. which discloses an umbrella structure for use on vehicles, such as tractors. This device includes a bracket that is attached to a back surface of a seat which is adapted to receive a support. Attached to the shaft via a ball and socket means is an umbrella shade. This ball and socket means is located above the shade and will enable the user to adjust the angular rotation of the shade. Though efficient, this device is bulky and non-compactable. Additionally, the location of the ball and socket means will provide for a device that is difficult to manipulate and adjust.

Another device is disclosed in U.S. Pat. No. 5,000,210 issue to Worthington which discloses a flat square shade that is adapted to be removably secured to a chair or other furniture via a plurality of clamps. Though the shade can be tilted, the height cannot be adjusted. Without an option for adjusting the height of the device there will inherently exist a limitation in the amount of blockage one will receive from sun rays.

None of these previous efforts provide the benefits intended with the present invention. Additionally, prior techniques do not suggest the present inventive combination of component elements as disclosed and claimed herein. The present invention achieves its intended purposes, objectives, and advantages over the prior art device through a new, useful and unobvious combination of component elements, which is simple to use, with the utilization of a minimum number of functioning parts, at a reasonable cost to manufacture, assemble, test, and by employing only readily available material.

SUMMARY OF THE INVENTION

The present invention provides for a screen device that is comprised of retaining means that is adapted to be secured onto a back surface of a seat or the like. This retaining means will receive a shaft. The shaft includes a first end and a second end. The first end includes a frame that extends perpendicularly from the shaft. A shade is secured to the frame in order to protect the user from sun, rain, or the like. The second end of the shaft is received in the retaining means.

The design and configuration of the screen of the present invention will provide a device that can be adjusted angularly, rotationally, as well as vertically, inherently providing an efficient and successful means of blocking the sun, rain or the like for the user via the shade. The adjustment of the screen device occurs by way of the retaining means and a holding mechanism.

Accordingly, it is an object of the present invention to provide for a screen device that will adequately provide protection for an individual from sun, rain, or the like.

It is yet another object of the present invention to provide for a screen device that includes a securing means that will place the shade in a fixed position in order to enable the user to utilize the screen device while in a moving vehicle, such as a boat, tractor, or the like.

Still a further object of the present invention is to provide for a screen device in accordance with the preceding objects and which will conform to conventional forms of manufacture, be of simple construction and easy to use so as to provide a device that would be economically feasible, long-lasting and relatively trouble free in operation.

Although there have been inventions related to a personal screen apparatus, none of the inventions have become sufficiently compact, low cost, and reliable enough to become commonly used. The present invention meets the requirements of the simplified design, compact size, low initial cost, low operating cost, ease of installation and maintainability, and minimal amount of training to successfully employ the invention.

The foregoing has outlined some of the more pertinent objects of the invention. These objects should be construed to be merely illustrative of some of the more prominent features and application of the intended invention. Many other beneficial results can be obtained by applying the disclosed invention in a different manner or modifying the invention within the scope of the disclosure. Accordingly, a fuller understanding of the invention may be had by referring to the detailed description of the preferred embodiments, in addition to the scope of the invention defined by the claims, taken in conjunction with the accompanying drawings.

BRIEF DESCRIPTION OF THE DRAWINGS

Similar reference numerals refer to similar parts throughout the several views of the drawings.

DESCRIPTION OF THE PREFERRED EMBODIMENTS

Figure 1:
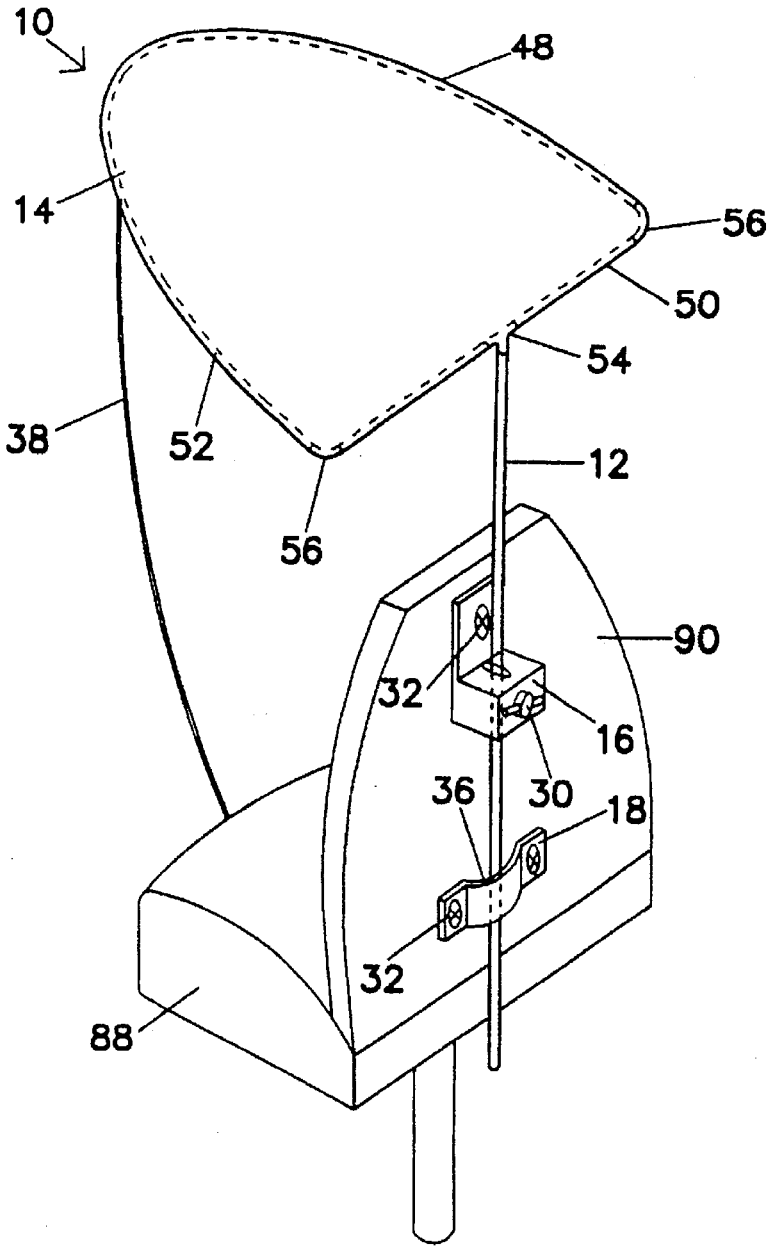
FIG. 1 is a perspective view of the first embodiment of the screen device of the present invention.

As illustrated in the various views (FIGS. 1–2*b*) of the first embodiment of the present invention, the personal screen device 10 comprises a shaft 12 that maintains a shade 14. This shaft is also adapted to be slidably secured to a holding mechanism 16 and retaining means 18.

The shaft 12 includes an upper portion or first end that is secured to the shade 14. This shade 14 includes a lower surface and an upper surface. This lower surface is secured to a frame 48 (illustrated in outline). The frame 48 is perpendicularly attached to the shaft 12 via a T-connector 54. Elbows 56 can be used in order to obtain the desired shape of the frame 48. It is noted that the frame can include any shape or configuration (such as U-shape, as illustrated, square, rectangular, or the like) so as to provide a means of adequately protecting the user from sun rays, rain, or the like. Accordingly, the shade 14 is fabricated from a variety of commercially available materials. It is preferred that the material used be durable, waterproof or water resistant, as well as offering protection from the sun (having a sun protection factor of at least 15).

The shaft 12 also includes a lower portion or second end that is adapted to be received in the holding mechanism 16 and retaining means 18. This holding mechanism and retaining means are secured to a back surface 90 of a seat 88. This holding means is co-linear and above the retaining mechanism 18.

Figure 2B:
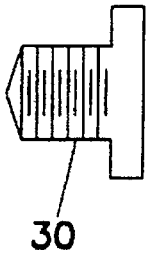
FIG. 2*b* is a perspective view of the retaining means of the first embodiment of the screen device of the present invention.
Figure 2B:
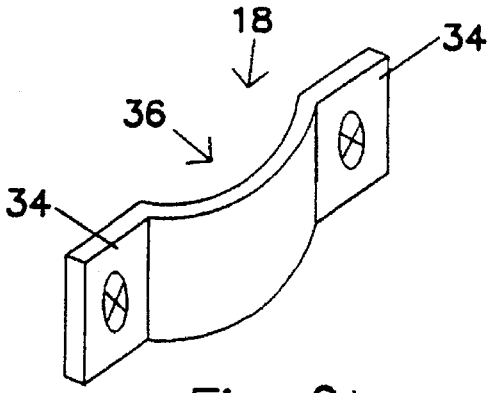
Figure 2A:
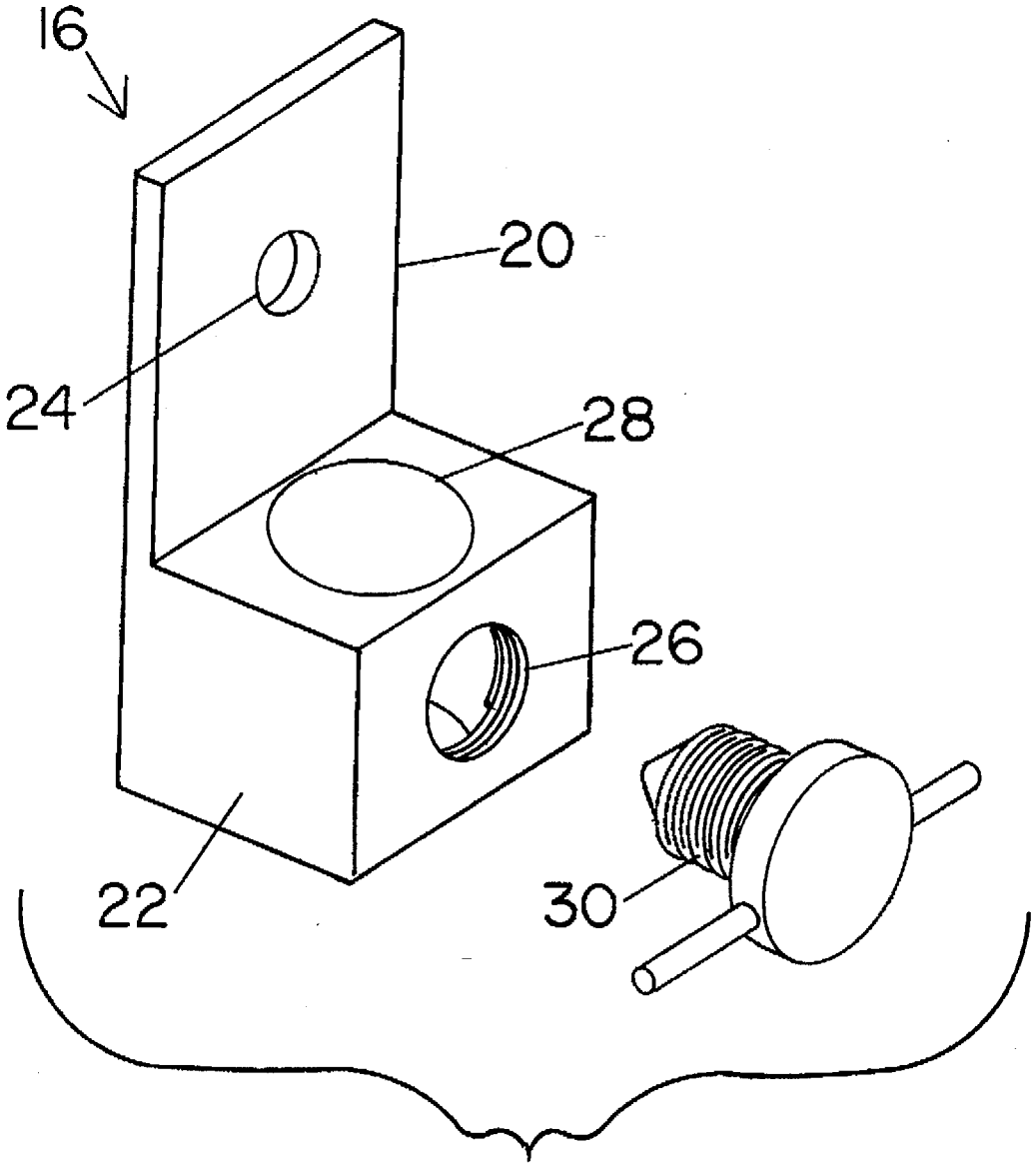
FIG. 2*a* is a perspective view of the holding and alternating mechanism used in the first embodiment of the present invention.

The holding mechanism 16 is illustrated in further detail in FIGS. 1 and 2*a*. As seen in these figures, holding mechanism 16 includes an upper portion 20 and a lower portion 22. The upper portion 20 includes a first aperture 24. This aperture is adapted to receive a screw 32, or the like in order to attach the holding mechanism to the back surface 90 of the seat 88.

The lower portion 22 of the holding mechanism 16 extends outwardly from the upper portion 20 and includes a second aperture 26 that extends horizontally therethrough.

A third aperture 28 extends vertically through the lower portion 22 and is adapted to receive the shaft 12 to provide for the shaft to slide freely within the third aperture. The shaft can be affixed in a locked position by way of a locking mechanism 30 that is adapted to contact the shaft 12 via the second aperture. The second aperture 26 and the locking mechanism 30 are threaded to provide for the locking mechanism within be threadably secured to the second aperture 26.

Hence, in order to secure the shaft in a fixed position, the shaft is first adjusted to a desired location in order to provide for the shade to be in a preferred position vertically and rotatably. Once the desired location is obtained, the locking means 30 is inserted into the second aperture 26 until contact is made between the tip of the locking means 30 and the shaft 12, thereby securing the shaft in a fixed position.

The T-connector 54 is secured to the top end of the shaft 12 to provide for the T-connector to be removably secured to the shaft. This design and configuration is discussed and is illustrated in further detail in FIGS. 4*a* and 4*b*.

The retaining means 18, illustrated in further detail in FIGS. 1 and 2*b* includes a center portion 36, that loops outwardly, with ends 34. These ends 34 include apertures (illustrated, but not labeled) that are adapted to receive screws 32 in order to secure the retaining means 18 to the back surface of the seat 88. The loop or center portion 36 receives the shaft 12 to provide for the shaft to be in a vertical position.

The screen device 10, of the present invention, can be secured to a seat 88 of a moving vehicle, such as a boat or the like via a holding means. This holding means will enable the shade of the device to be in a fixed position and not be blown away while the vehicle is being utilized. In order to do so, the screen device 10 provides for the holding means to be a string, cable, or rope device 38 that is secured to the under surface or lower surface of the shade 14. This rope device would be secured to the conventional seat 88. Thereby, providing for shade to be in a secured position.

The second embodiment of the present invention is illustrated in further detail in FIGS. 3–6*b*. As seen in these figures, the second embodiment of the screen device 10 includes a shaft 12 that maintains a shade 14. This shaft is also adapted to be slidably secured to a holding mechanism 16 and retaining means 18.

The shaft 12 includes an upper portion or first end that is secured to a frame 48 (illustrated in outline). Attached to the frame 48 is a shade 14. This shade 14 includes a lower surface 42 and an upper surface 44. The lower surface is secured to the frame 48 (illustrated in outline). The frame 48 is perpendicularly attached to the shaft 12 via a T-connector 54. Elbows 56 can be used in order to obtain the desired shape of the frame 48. It is noted that the frame can include any shape or configuration (such as U-shape, as illustrated, square, rectangular, or the like) so as to provide a means of adequately protecting the user from sun rays, rain or the like. It is preferred that the material used by durable, water proof or water resistance, as well as offering protection from the sun (having a sun protection factor of at least 15).

The frame 48 of the shade is secured to the top end of the shaft 12 by T-connector 54. This T-connector is adapted to be removably secured to the shaft in order to provide for a shade that is collapsible, inherently providing for a device that is portable. This means of securing the T-connector to the shaft 12 is illustrated and discussed in further detail in FIGS. 4*a* and 4*b*.

Figure 3:
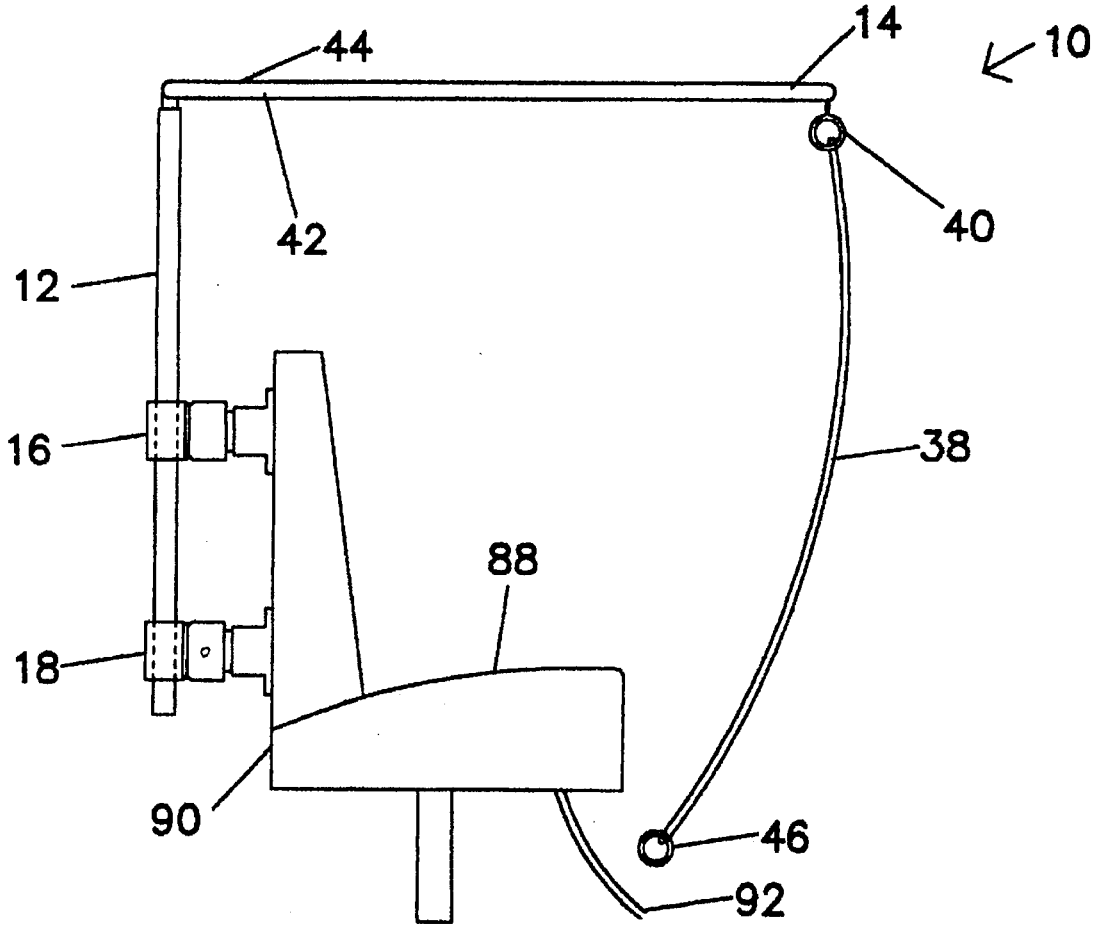
FIG. 3 is a side plan view of the second embodiment of the screen device of the present invention.
Figure 5:
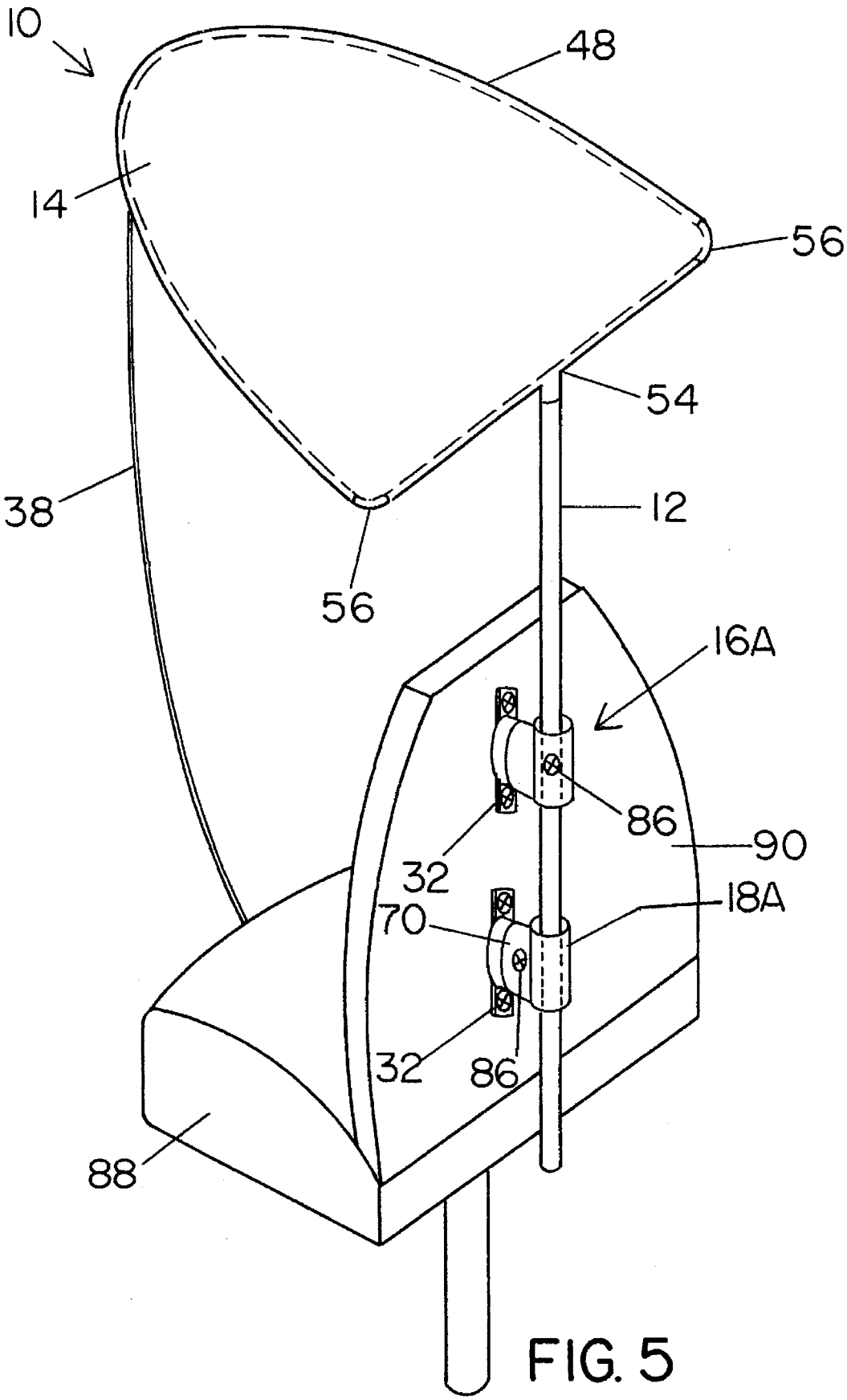
FIG. 5 is a perspective view of the second embodiment of the screen device of the present invention.

The shaft 12, illustrated in FIGS. 3 and 5 also includes a lower portion that is adapted to be received in the holding mechanism 16 and retaining means 18. This holding mechanism and retaining means are secured to a back surface 90 of a seat 88. This holding means is co-linear and above the retaining mechanism 18.

Figure 6B:
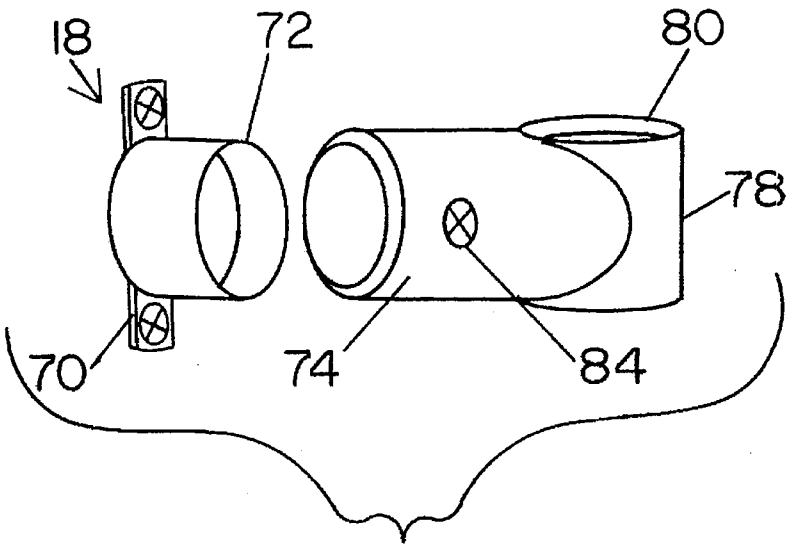
FIG. 6*b* is a perspective view of the retaining means of the second embodiment of the screen device of the present invention.
Figure 6A:
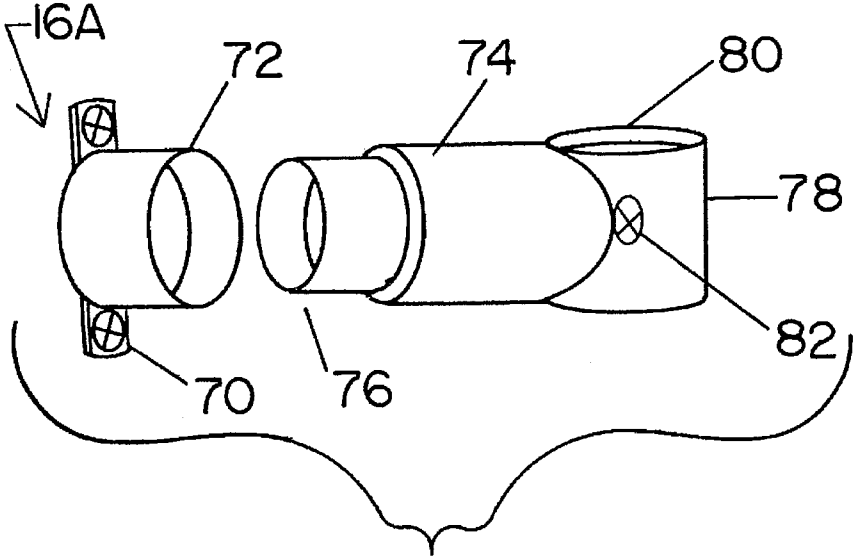
FIG. 6*a* is a perspective view of the holding mechanism of the second embodiment of the sun shade device of the present invention.

The holding mechanism is illustrated in further detail in FIGS. 3, 5, and 6*a*. As seen in these figures the holding mechanism 16 includes a back plate 70 that is adapted to be secured to the back surface 90 of the seat 88 via screws 32. Extending outwardly from the back plate 70 is a male receiving means 72. This male receiving means 72 is adapted to receive a female receiving end 76. An adhesive may be applied to either the male receiving means or to the female receiving end 76 to provide for the two ends to be permanently secured. A first portion 78 is secured to the female receiving means 76 via an extension 74. It is noted that this extension is not needed and can be eliminated, as illustrated in FIG. 6*b*. Extending through the first portion 78 is an opening 80. This opening is adapted to receive the second end of the shaft in order to provide the shaft to be in a slidable relationship within the opening 80. The shaft can be secured in a fixed position via a second opening 82. This second opening 82 is adapted to receive a screw (illustrated, but not labeled in FIG. 6*a*). Once contact is made between the screw and shaft 12, the shaft will be in a fixed and locked position.

The retaining means 18 is illustrated in further detail in FIGS. 3, 5, and 6*b*. As seen in these figures, the retaining means 18 includes a back plate 70 that is adapted to be secured to the back surface 90 of the seat 88 via screws 32. Extending outwardly from the back plate 70 is a male receiving means 72. This male receiving means 72 is adapted to receive a female receiving end 74. This will provide for the female receiving end 74 to be able to slide freely on the male receiving end 72 (see FIGS. 3 and 5). A first portion 78 is secured to the female receiving means 74. Extending vertically through the first portion 78 is an opening 80. This opening is adapted to receive the second end of the shaft in order to provide for the shaft to be in a slidable relationship within the opening 80. Extending through the female receiving means 74 is a second aperture 84. This opening will permit for the appropriate tilt of the shade 14. Accordingly, the female receiving means 74 is adapted to slide freely on the male receiving means 72. This sliding will inherently cause the shade 14 to be moved horizontally as well as to be tilted.

In order to do the adjustments, the shaft is inserted into openings 80 located in portion 78. Once in place, vertical and rotational positioning occurs via apertures 80 and 82 within the holding mechanism. Horizontal and tilting positioning occurs via aperture 84 of the retaining means. Once a desired position is obtained, screws are inserted into apertures 82 and 84, respectively, in order to maintain the shaft in a secured position and to provide for the shade to be in a desired location. It is noted that an extension, similar to the one illustrated in FIG. 6*a* can be located between the female receiving means and first portion 78.

It is noted that the holding mechanism and the retaining means can include the embodiments illustrated in FIGS. 6*a* or 6*b*. However, when utilized on the seat, the embodiment used for the holding mechanism must be similar to the embodiment used for the retaining means. Hence, if an extension is utilized for the retaining means, then an extension must be utilized for the holding mechanism.

The screen device 10, of the present invention, can be secured to a seat 88 of a moving vehicle, such as a boat or the like via a holding means. This will enable the shade of the device to be in a fixed position and not be blown away while the vehicle is being utilized. In order to do so, the under surface or lower surface 42 of the screen device 10 includes an eyelet or the like 40, as seen in FIGS. 3 and 5. The holding means will provide for a string or the like 38 to be secured to this eyelet 40 or optionally the string or the like 38 can be directly secured to the lower surface 42 of the shade 4. This string would be secured to the conventional seat 88 via a second string 92 that is typically located on the under surface of boating seats. Optionally, as illustrated in FIG. 3, the string can include a second eyelet 46 that would be adapted to receive the second string 92. Accordingly, securing the string 38 to a second string 92 will provide for the screen device 10 to be in a secured and fixed position.

The shaft 12 is adapted to be removably secured to the frame 48. This will provide for the shade device 10 of the first and second embodiment to be collapsible. To provide for the shaft to be removably secured to the frame, a first means and a second means are provided.

Figure 4A:
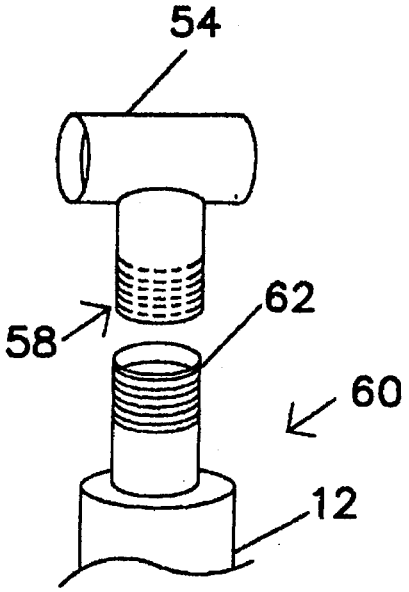
FIG. 4*a* is a side view of the first form of the attachment of the shaft to the frame used in the screen device of the present invention.

The first means of enabling the T-connector to be removably secured to the shaft 12 is illustrated in FIG. 4*a*. As seen in this figure, the shaft 12 includes a top end 60 that is threaded at portion 62. The T-connector 52 includes an internally threaded portion 58, thereby providing for the T-connector to be threadably secured to the shaft 12.

Figure 4B:
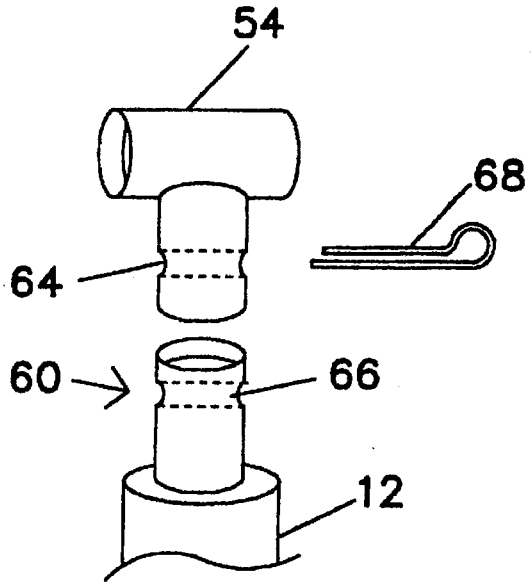
FIG. 4*b* is a side view of an alternative form of attachment of the shaft to the frame used in the screen device of the present invention.

A second means of enabling the T-connector to be removably secured to the shaft 12 is illustrated in FIG. 4*b*. As seen in this figure, the shaft includes a top end 60 which includes a horizontally located first aperture 66. The T-connector 54 includes another horizontally located second aperture 64 that is adapted to align with the first aperture 66 once the T-connector is attached to the top end 60 of the shaft. A pin 68 is adapted to be inserted into the horizontal openings in order to provide for the T-connector to be in a locked and fixed position on the shaft 12.

Figure 7:
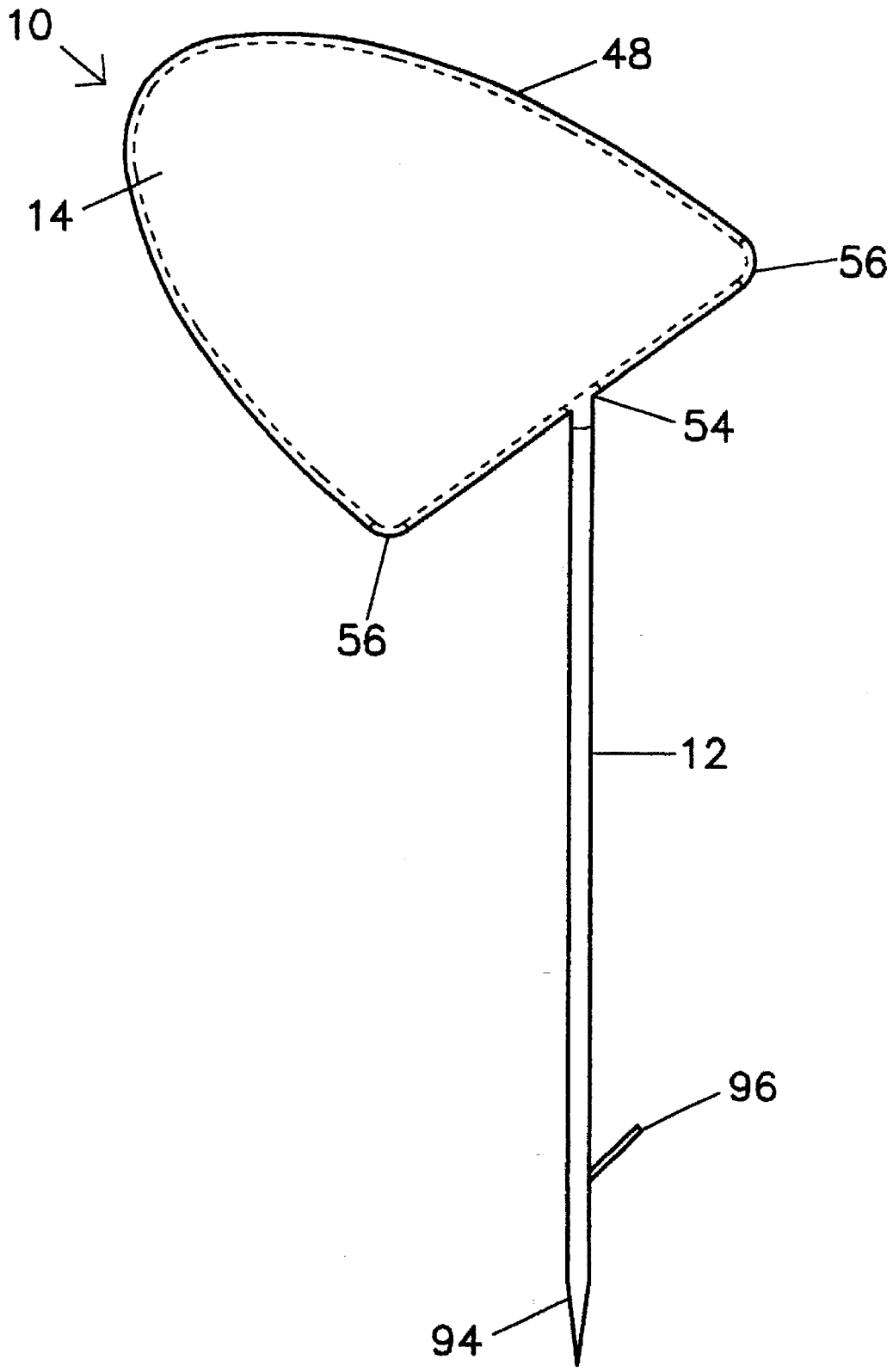
FIG. 7 is a perspective view of the third embodiment of the sun shade device of the present invention.

A third embodiment of the present invention is illustrated in FIG. 7. In this embodiment, the personal screen 10 of the present invention is adapted to be inserted into a ground, sand, or the like. The screen 10 includes a shaft 12 having a shade 14 attached thereto. This shade is similar in design and configurations as the shade illustrated and discussed in first and second embodiments of the present invention. Accordingly, the shade is secured to a frame 48 (illustrated in outline). The frame 48 is perpendicularly attached to the shaft 12 via a T-connector 54. Elbows 56 can be used in order to obtain the desired shape of the frame 48. It is noted that the frame can include any shape or configuration (such as U-shape, as illustrated, square, rectangular, or the like) so as to provide a means of adequately protecting the user from sun rays, rain, or the like.

Located on the lower end of the shaft 12 is a stake 94. This stake is adapted to be inserted into the ground, dirt, sand or the like. A foot pedal 96 can be located in the proximity of the stake in order to provide for an easy means of inserting the screen device 10 into the ground.

While the invention has been particularly shown and described with reference to an embodiment thereof, it will be understood by those skilled in the art that various changes in form and detail may be made without departing from the spirit and scope of the invention.

I claim:

1. A personal screen device comprising:

a holder, having a body portion with a vertical aperture extending therethrough and a threaded horizontal aperture extending thereinto, attached to a back surface of a chair;

a retainer, having a first end and a second end attached to the back surface of the chair and a bowed central portion forming a closed loop with the back of the chair, the closed loop being aligned with and below the vertical aperture;

a shaft, having a top end and a bottom end, slidably disposed and positioned within the vertical aperture and the closed loop and secured within the vertical aperture by a threaded locker threadably disposed within the horizontal aperture and pressure contacting the shaft;

a frame, having a T-connector, removably attached to the top of the shaft; and a shade secured to the frame.

2. The device as in claim 1 wherein the T-connector is threadably secured to the top of the shaft.

3. The device as in claim 1 further comprising:

a first pin aperture horizontally extending through the top of the shaft;

a second pin aperture horizontally extending through the T-connector and aligned with the first pin aperture; and a pin removably inserted through the first pin aperture and the second pin aperture.

4. The device as in claim 1 further comprising a securement string, having a first end attached to the frame and a second end attached to a chair string.

5. The device as in claim 1 further comprising;

a first eyelet attached to the frame;

a second eyelet attached to the chair; and a string connecting the first eyelet to the second eyelet.

6. A personal screen device comprising:

a first female receptacle, attached to a back surface of a chair;

a first body portion, having a first male end slidably received within the first female receptacle and a first looped portion having a horizontal aperture;

a second female receptacle, attached to the back surface of the chair below the first female receptacle;

a second body portion, having a second male end slidably received within the second female receptacle and a second looped portion;

a shaft, having a top end and a bottom end, slidably disposed and positioned within the first looped portion and the second looped portion and secured within the first looped portion by a screw secured within the horizontal aperture and pressure contacting the shaft;

a frame, having a T-connector, removably attached to the top of the shaft; and a shade secured to the frame.

7. The device as in claim 1 herein the T-connector is threadably secured to the top of the shaft.

8. The device as in claim 1 further comprising:

a first pin aperture horizontally extending through the top of the shaft;

a second pin aperture horizontally extending through the T-connector and aligned with the first pin aperture; and a pin removably inserted through the first pin aperture and the second pin aperture.

9. The device as in claim 6 further comprising a securement string, having a first end attached to the frame and a second end attached to a chair string.

10. The device as in claim 6 further comprising;

a first eyelet attached to the frame;

a second eyelet attached to the chair; and a string connecting the first eyelet to the second eyelet.

* * * * *